US008439727B1

(12) United States Patent
Woodard

(10) Patent No.: US 8,439,727 B1
(45) Date of Patent: May 14, 2013

(54) DRILL BIT SHARPENING TOOL

(76) Inventor: Leo F. Woodard, Lakeland, FL (US)

( * ) Notice: Subject to any disclaimer, the term of this patent is extended or adjusted under 35 U.S.C. 154(b) by 0 days.

(21) Appl. No.: 13/567,735

(22) Filed: Aug. 6, 2012

(51) Int. Cl.
*B24B 19/00* (2006.01)

(52) U.S. Cl.
USPC ..... 451/375; 451/349; 451/361

(58) Field of Classification Search ..... 451/48, 451/278, 340, 349, 361, 371, 375, 378, 386, 451/391
See application file for complete search history.

(56) References Cited

U.S. PATENT DOCUMENTS

| | | | | | |
|---|---|---|---|---|---|
| 1,576,311 | A | | 3/1926 | Des Jardins | |
| 1,944,540 | A | | 1/1934 | Bailey | |
| 2,202,819 | A | | 6/1940 | Yantiss | |
| 2,821,820 | A | | 2/1958 | Thumann | |
| 2,887,833 | A | | 5/1959 | Passarotti | |
| 3,060,645 | A | | 10/1962 | Waggoner | |
| 3,121,983 | A | | 2/1964 | English | |
| 3,221,727 | A | * | 12/1965 | Pitcl et al. | 125/11.01 |
| 3,373,530 | A | | 3/1968 | Cooprider | |
| 3,393,476 | A | | 7/1968 | York | |
| 3,411,249 | A | | 11/1968 | Tidwell | |
| 3,482,325 | A | | 12/1969 | Mitchell | |
| 3,703,055 | A | * | 11/1972 | Niquet | 451/375 |
| 3,952,459 | A | * | 4/1976 | Negley | 451/375 |
| 4,164,100 | A | * | 8/1979 | Wolff | 451/410 |
| 4,176,499 | A | * | 12/1979 | Mazoff | 451/276 |
| 4,404,773 | A | | 9/1983 | Gauger | |
| 4,520,599 | A | * | 6/1985 | Slinsky | 451/375 |
| 4,566,227 | A | * | 1/1986 | Wolff | 451/375 |
| 4,607,463 | A | | 8/1986 | Slinsky | |
| 4,658,549 | A | * | 4/1987 | Lockwood | 451/216 |
| 4,744,178 | A | | 5/1988 | Afshar | |
| 4,848,036 | A | | 7/1989 | Kiso | |
| 5,241,791 | A | | 9/1993 | Lacy | |
| D356,483 | S | | 3/1995 | Fultz et al. | |
| 5,525,095 | A | * | 6/1996 | Baughman | 451/72 |
| 5,620,363 | A | | 4/1997 | Hepworth | |
| 5,676,592 | A | * | 10/1997 | Borgatti | 451/454 |
| 6,001,002 | A | * | 12/1999 | Lea | 451/48 |
| 6,123,611 | A | * | 9/2000 | Lawrence, Jr. | 451/361 |
| D458,617 | S | * | 6/2002 | Wang | D15/124 |
| 6,676,494 | B1 | | 1/2004 | Ching | |
| 2011/0171884 | A1 | * | 7/2011 | Jansson et al. | 451/48 |

* cited by examiner

*Primary Examiner* — Eileen P. Morgan

(57) ABSTRACT

A drill bit sharpening system using a typical bench grinder with a removable table for refurbishing a dull or broken drill bit has a bench grinder with a motor, a sharpening wheel, and a generally planar positioning table. The system has a generally planar rigid sharpening table with a securing means for rigidly attaching to the positioning table in a removable manner. The system has a pivotally mounted positioning component on the table top surface. The positioning component has a generally "L" shaped cross-section in a transverse plane. The positioning component has a centrally located pivoting means for mounting to a sharpening table top surface.

9 Claims, 9 Drawing Sheets

DRILL BIT SHARPENING TOOL

CROSS REFERENCE

This application claims priority to U.S. non-provisional application Ser. No. 12/429,103 filed Apr. 23, 2009 as a continuation-in-part, the specification of which is incorporated herein by reference in its entirety.

BACKGROUND OF THE INVENTION

A bench grinder is a machine found in many metal working shops and home workshops. This type of machine, often used for sharpening hand tools, has a rotating wheel with an abrasive grinding surface for removing material from the tool for forming an edge or surface. To sharpen drill bits, however, a specialized sharpening machine is often used in order to grind an edge on the drill bit with an angle suitable for drilling, however these machines are generally very expensive. The present invention features a drill bit sharpening system using a typical bench grinder with a removable table for refurbishing a dull or broken drill bit.

SUMMARY

The present invention features a drill bit sharpening system using a typical bench grinder with a table for refurbishing a dull or broken drill bit. In some embodiments, the system comprises a bench grinder having a motor, a sharpening wheel, and a generally planar positioning table. In some embodiments the system comprises a generally planar rigid sharpening table. In some embodiments, the bottom table surface comprises a table mount for rigidly attaching to the positioning table in a removable manner. In some embodiments the system comprises a positioning component on the table top surface. In some embodiments, the positioning component comprises a generally "L" shaped cross-section in a transverse plane. In some embodiments, the positioning component comprises a centrally located pivoting means for mounting to a sharpening table top surface. In some embodiments, the positioning component rotates about the pivoting means.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
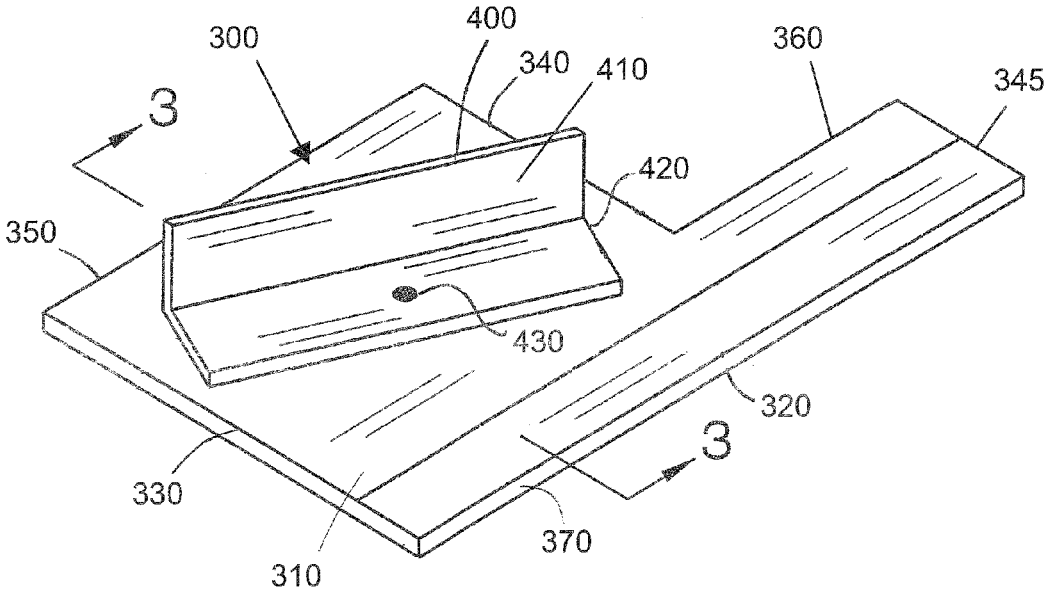
FIG. 1 is a perspective view of the sharpening table and the positioning component of the present invention.
Figure 2:
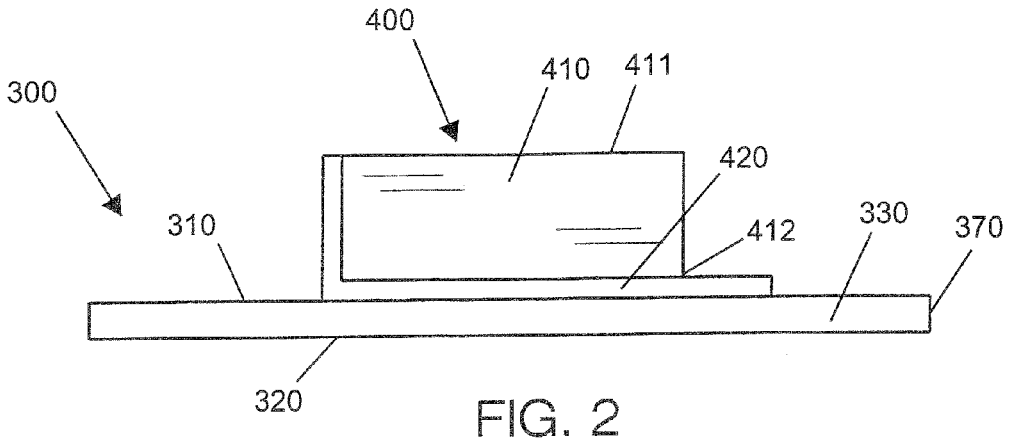
FIG. 2 is a front view of the sharpening table and the positioning component of the present invention.
Figure 3:
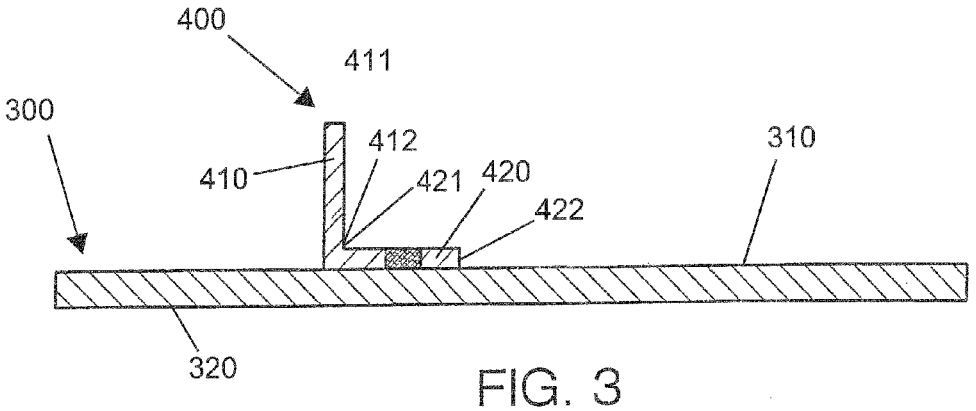
FIG. 3 is a cross-sectional view in a coronal plane of the sharpening table and the positioning component of the present invention.
Figure 4:
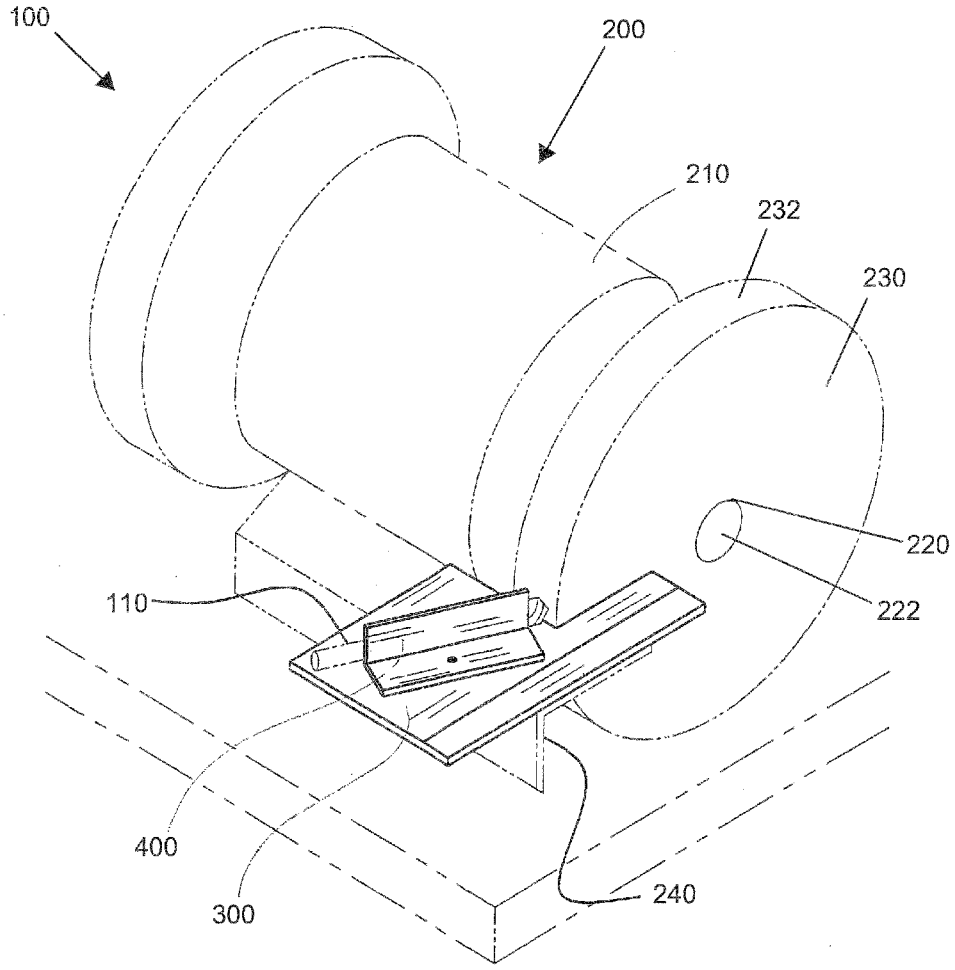
FIG. 4 is a perspective view of the present invention.
Figure 5:
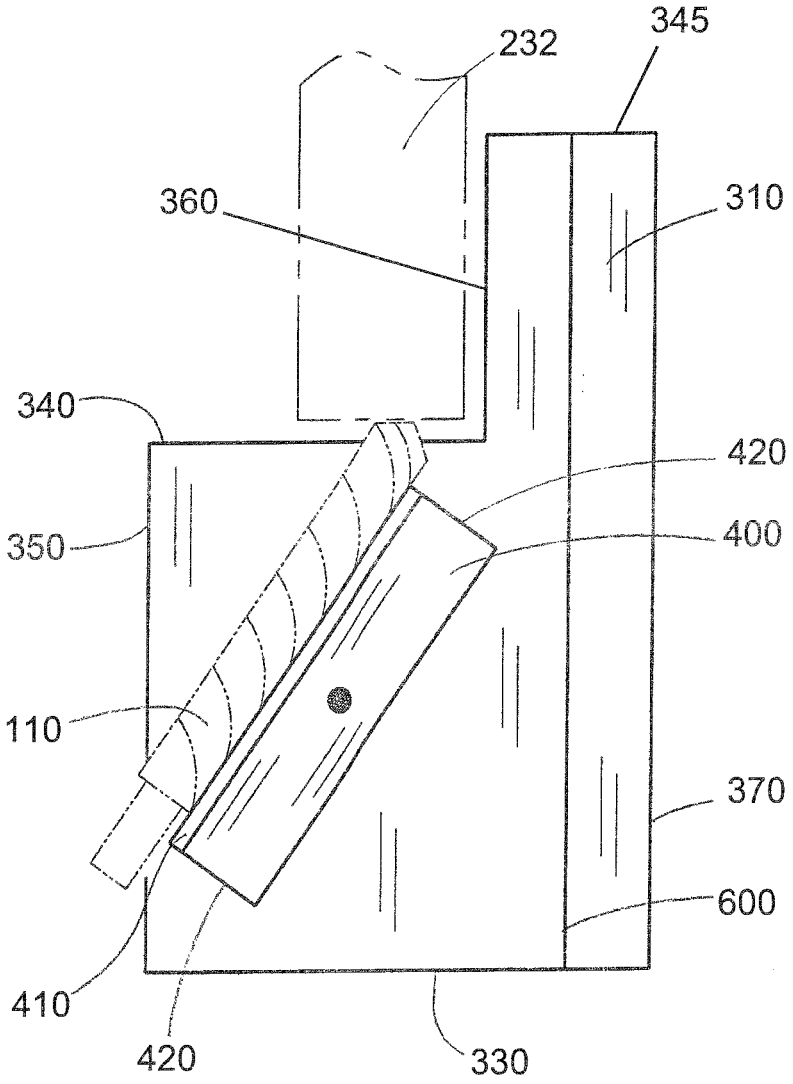
FIG. 5 is a top view of the present invention.
Figure 6:
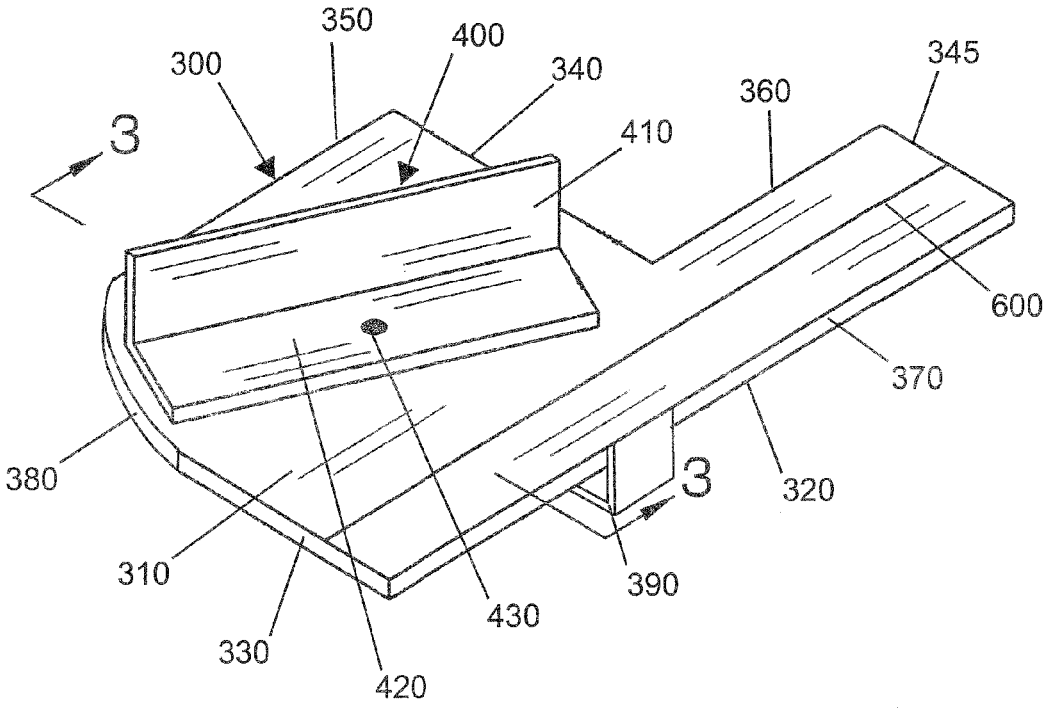
FIG. 6 is a perspective view of an alternate embodiment of the sharpening table and the positioning component of the present invention.
Figure 7:
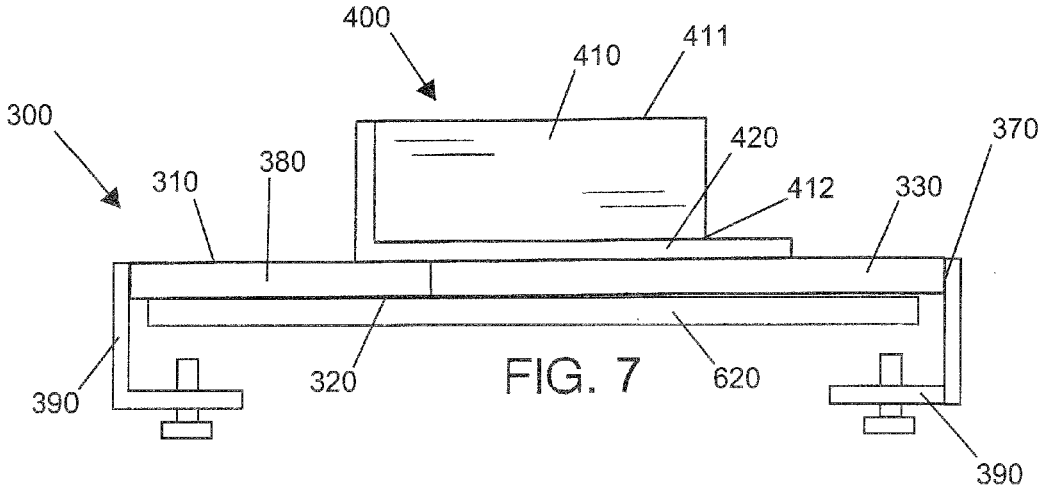
FIG. 7 is a front view of an alternate embodiment of the sharpening table and the positioning component of the present invention.
Figure 8:
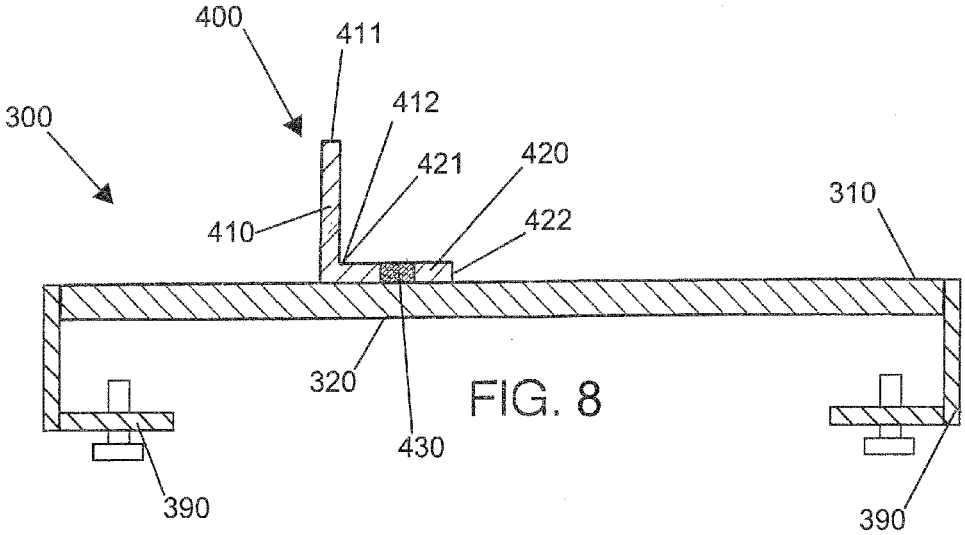
FIG. 8 is a cross-sectional view in a coronal plane of an alternate embodiment of the sharpening table and the positioning component of the present invention.
Figure 9:
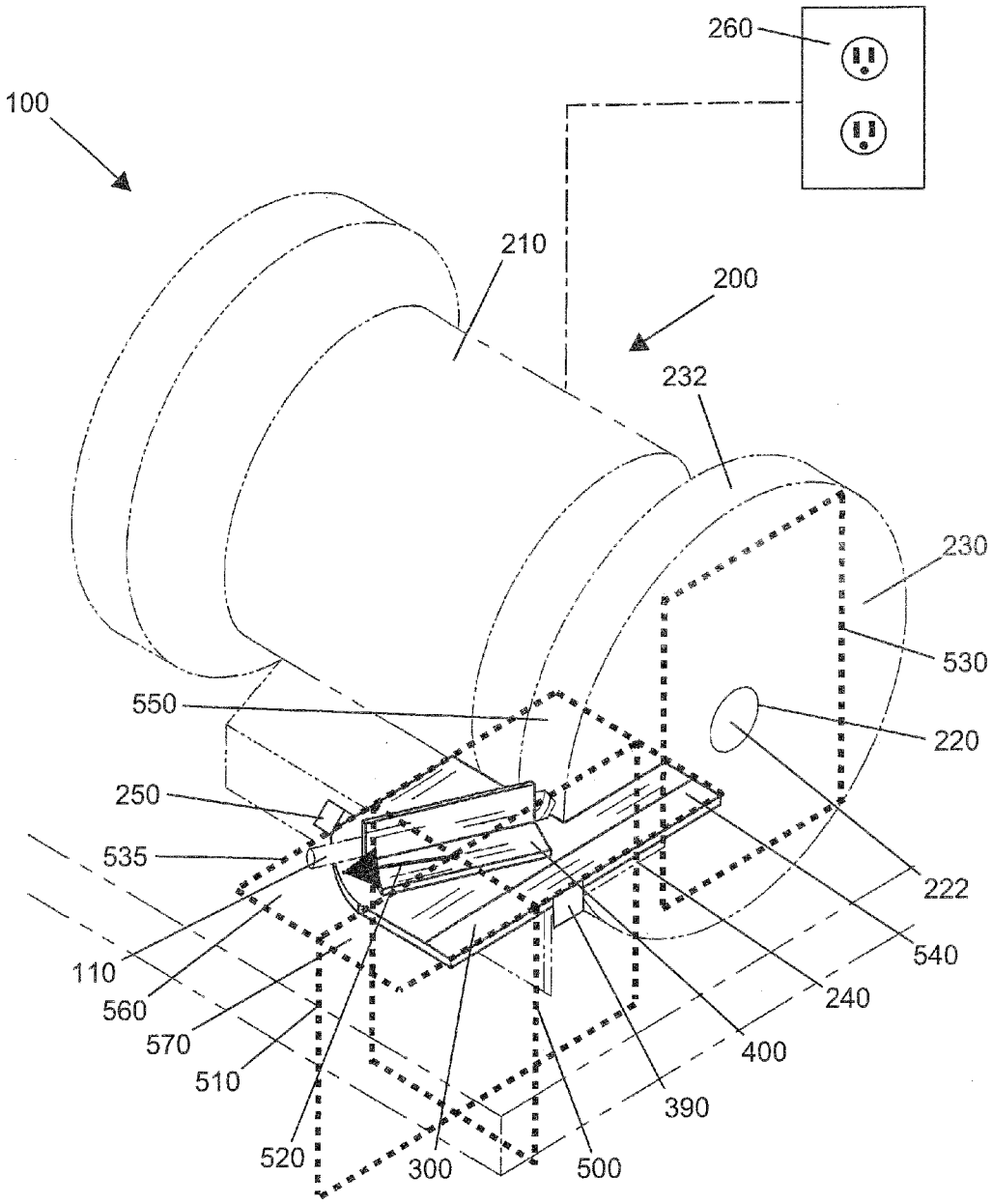
FIG. 9 is a perspective view of an alternate embodiment of the present invention.
Figure 10:
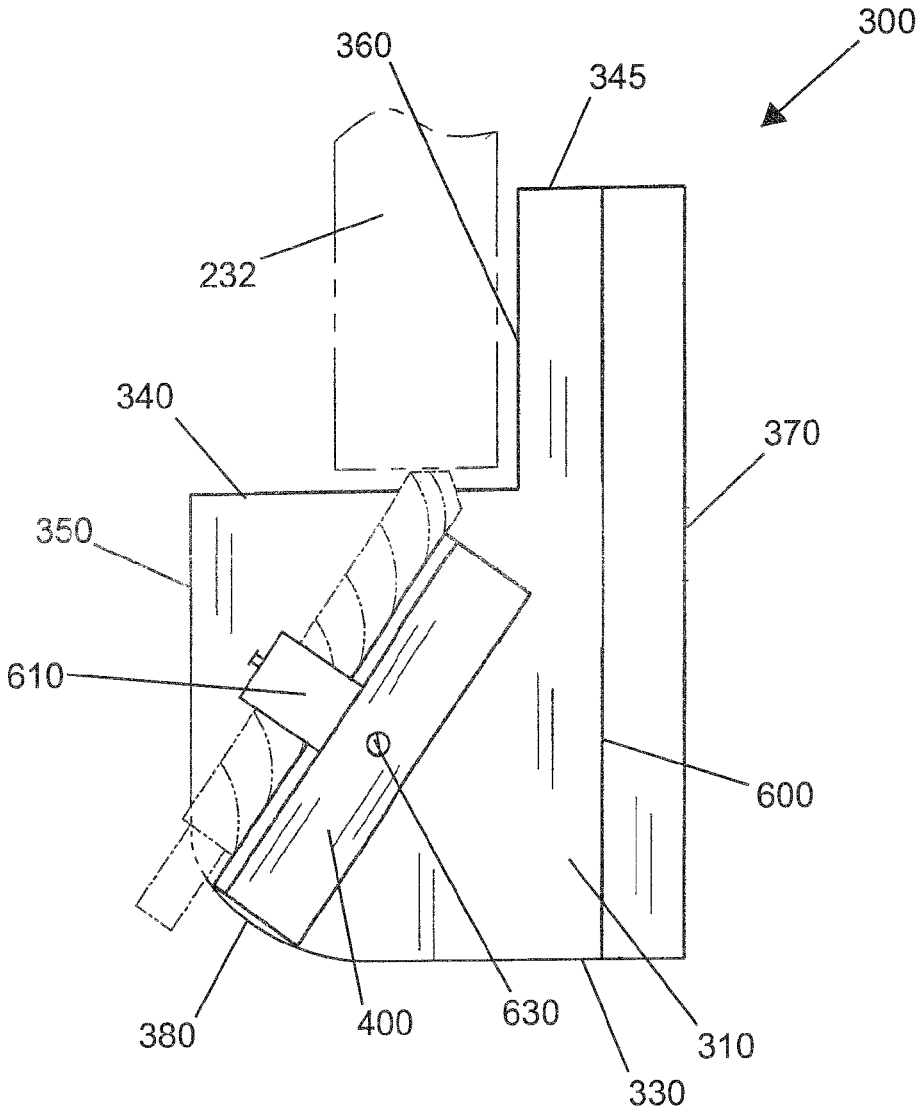
FIG. 10 is a top view of an alternate embodiment of the present invention.

Following is a list of elements corresponding to a particular element referred to herein:

100 Drill bit sharpening system
110 Drill bit
200 Bench grinder
210 Motor
220 Rotating shaft
222 Shaft end
230 Sharpening wheel
232 Sharpening wheel face
240 Positioning table
250 Power switch
260 Power source
300 Sharpening table
310 Top table surface
320 Bottom table surface
330 Anterior table edge, also referred to as first table edge
340 First posterior table edge, also referred to as third table edge
345 Second posterior table edge, also referred to as fifth table edge
350 Anterior first table edge, also referred to as sixth table edge
360 Posterior first table edge, also referred to as fourth table edge
370 Second table edge
380 Rounded recessed edge
390 Table mount
400 Positioning component
410 Vertical component, also referred to as a wall component
411 First vertical component edge, also referred to as first wall component edge
412 Second vertical component edge, also referred to as second wall component edge
420 Horizontal component, also referred to as floor component
421 First horizontal component edge, also referred to as first floor component edge
422 Second horizontal component edge, also referred to as second floor component edge
430 Pivoting means
500 Plane A
510 Plane B
520 Radius E
530 Plane C
535 Plane D
540 First quadrant
550 Second quadrant

560 Third quadrant
570 Fourth quadrant
600 Guide line
610 Clamping means
620 Spacer block
622 Spacer block first edge
624 Spacer block second edge
630 Securing means Referring now to FIGS. 1-11B, the present invention features a drill bit sharpening system (100) using a typical bench grinder (200) with a sharpening table (300) for refurbishing a dull or broken drill bit (110). In some embodiments, the system (100) comprises a bench grinder (200) having a motor (210) operatively coupled to a rotating shaft (220). In some embodiments, the rotating shaft (220) comprises a sharpening wheel (230) located on a shaft end (222). In some embodiments, the bench grinder (200) comprises a generally planar positioning table (240) located in an anterior position thereon with respect to a sharpening wheel face (232). In some embodiments, the motor (210) is operatively connected to a power switch (250) and a power source (260).

In some embodiments the system (100) comprises a generally planar rigid sharpening table (300) having a top table surface (310), a bottom table surface (320) opposite to and generally parallel with the top table surface (310), an anterior table edge (330), a first posterior table edge (340) close to the sharpening wheel face (232), a second posterior table edge (345), an anterior first table edge (350), a posterior first table edge (360), and a second table edge (370) opposite to and parallel with the anterior first table edge (350) and the posterior first table edge (360). In some embodiments, the system (100) comprises a positioning component (400) located on the table top surface (310) comprising an elongated planar vertical component (410) having a first vertical component edge (411), and a second vertical component edge (412). In some embodiments, the positioning component (400) further comprises an elongated planar horizontal component (420) having a first horizontal component edge (421) and a second horizontal component edge (422). In some embodiments, the first horizontal component edge (421) is perpendicularly attached to the second vertical component edge (412). In some embodiments, the positioning component (400) comprises a generally "L" shaped cross-section in a transverse plane.

In some embodiments, for use, the sharpening table (300) is attached to the positioning table (240) of the bench grinder (200). In some embodiments, the bench grinder (200) is activated via the power switch (250) and the power source (260). In some embodiments, the motor (210) rotates the sharpening wheel (230) via the rotating shaft (220). In some embodiments, for operation, the drill bit (110) is placed against the positioning component (400) on the sharpening table (300) and held against the rotating sharpening wheel face (232) for shaping. In some embodiments, the drill bit (110) is manually rotated against the sharpening wheel face (232) via a users fingers on the drill bit (110).

In some embodiments, the generally planar rigid sharpening table (300) comprises a rounded recessed edge (380) adjoining the anterior table edge (330) and the anterior first table edge (350). In some embodiments, a vertical plane, Plane A (500), is about midway between the anterior table edge (330) and the first posterior table edge (340). In some embodiments, a vertical plane, Plane B (510), is about midway between the anterior first table edge (350) and the posterior first table edge (360). In some embodiments, Plane B (510) is located parallel with a vertical plane, Plane C (530), on which the sharpening wheel (230) is located. In some embodiments, Plane B (510) is perpendicular to Plane A (500). In some embodiments, the rounded recessed edge (380) is located on a radius, Radius E (520). In some embodiments, Radius E (520) comprises a center located at an intersection of Plane A (500) and Plane B (510). In some embodiments, a plane, Plane D (535) is located perpendicular to Plane A (500), Plane B (510), and Plane C (530). In some embodiments, the top table surface (310) lies on Plane D (535). In some embodiments, Plane D (535) is divided into four quadrants by intersecting planes, Plane A (500) and Plane B (510). In some embodiments, an intersection of the second posterior table edge (345) and the second table edge (370) lies in a first quadrant (540). In some embodiments, an intersection of the anterior first table edge (350) and the first posterior table edge (340) lies in a second quadrant (550). In some embodiments, the rounded recessed edge (380) lies in a third quadrant (560). In some embodiments, an intersection of the anterior table edge (330) and the second table edge (370) lies in a fourth quadrant (570).

In some embodiments, the positioning component (400) comprises a pivoting means (430) centrally located therein for rotatably mounting to a top table surface (310). In some embodiments, the pivoting means (430) is located on the top table surface (310) on a vertical plane, Plane A (500), about midway between the anterior table edge (330) and the first posterior table edge (340). In some embodiments, the pivoting means (430) is located on the top table surface (310) on a vertical plane, Plane B (510), about midway between the anterior first table edge (350) and the posterior first table edge (360). In some embodiments, Plane B (510) is located parallel with a vertical plane, Plane C (530), on which the sharpening wheel (230) is located. In some embodiments, Plane B (510) is perpendicular to Plane A (500). In some embodiments, the pivoting means (430) is located on the top table surface (310) at an intersection of Plane A (500) and Plane B (510). In some embodiments, the positioning component (400) rotates about the pivoting means (430) in a horizontal plane.

In some embodiments, the bottom table surface (320) comprises a table mount (390) located thereon for removably and rigidly attaching to the positioning table (240).

In some embodiments, the system (100) comprises a spacer block (620) for adjusting a planar elevation of the sharpening table (300) with respect to the positioning table (240). In some embodiments, the angle of the sharpening wheel face (232) with respect to the drill bit (110) is set to a predetermined value based on an elevation of the sharpening table (300). In some embodiments, the spacer block (620) is located on the bottom table surface (320). In some embodiments, the spacer block (620) comprises a predetermined thickness.

In some embodiments, the present invention features a drill bit sharpening system (100) using a typical bench grinder (200) with a removable table for refurbishing a dull or broken drill bit (110). In some embodiments, the system (100) comprises a bench grinder (200) having a motor (210) that powers a rotating shaft (220). In some embodiments, the rotating shaft (220) comprises a sharpening wheel (230) located on a shaft end (222). In some embodiments, the bench grinder (200) further comprises a generally planar positioning table (240) located in an anterior position thereon with respect to a radial sharpening wheel face (232). In some embodiments, the motor (210) is operatively connected to a power switch (250) and a power source (260).

In some embodiments, the system (100) comprises a generally planar rigid sharpening table (300) having a top table surface (310), a bottom table surface (320) opposite to and generally parallel with the top table surface (310), an anterior table edge (330), a first posterior table edge (340) close to the sharpening wheel face (232), a second posterior table edge (345), an anterior first table edge (350), a posterior first table edge (360), and a second table edge (370) opposite to and parallel with the anterior first table edge (350) and the posterior first table edge (360), a rounded recessed edge (380) adjoining the anterior table edge (330) and the anterior first table edge (350). In some embodiments, the bottom table surface (320) comprises a table mount (390) located thereon for removably and rigidly attaching to the positioning table (240). In some embodiments, the table mount (390) comprises a clamping screw for tightening thereby securing the table mount (390) to the positioning table (240).

In some embodiments, the rounded recessed edge (380) is recessed to provide clearance for fingers of a user for adjusting the drill bit (110). In some embodiments, the drill bit (110) projects past and away from the rounded recessed edge (380). In some embodiments, the projecting drill bit (110) allows the user to manually adjust (or rotate) the drill bit during a sharpening operation.

In some embodiments, the system (100) comprises a pivotally mounted positioning component (400) located on the table top surface comprising an elongated planar vertical component (410) having a first vertical component edge (411), and a second vertical component edge (412). In some embodiments, the positioning component (400) further comprises an elongated planar horizontal component (420) having a first horizontal component edge (421) and a second horizontal component edge (422). In some embodiments, the first horizontal component edge (421) is perpendicularly attached to the second vertical component edge (412). In some embodiments, the positioning component (400) comprises a generally "L" shaped cross-section in a transverse plane. In some embodiments, the positioning component (400) comprises a pivoting means (430) centrally located therein for rotatably mounting to a top table surface (310).

In some embodiments, the pivoting means (430) is located on the top table surface (310) on a vertical plane, Plane A (500), about midway between the anterior table edge (330) and the first posterior table edge (340). In some embodiments, the pivoting means (430) is located on the top table surface (310) on a vertical plane, Plane B (510), about midway between the anterior first table edge (350) and the posterior first table edge (360). In some embodiments, Plane B (510) is located parallel with a vertical plane, Plane C (530), on which the sharpening wheel (230) is located. In some embodiments, Plane B (510) is perpendicular to Plane A (500). In some embodiments, the pivoting means (430) is located on the top table surface (310) at an intersection of Plane A (500) and Plane B (510). In some embodiments, the positioning component (400) rotates about the pivoting means (430).

In some embodiments, the rounded recessed edge (380) is located on a radius, Radius E (520). In some embodiments, Radius E (520) comprises a center located at the intersection of Plane A (500) and Plane B (510). In some embodiments, a plane, Plane D (535) is located perpendicular to Plane A (500), Plane B (510), and Plane C (530). In some embodiments, the top table surface (310) lies on Plane D (535). In some embodiments, Plane D (535) is divided into four quadrants by intersecting planes, Plane A (500), and Plane B (510). In some embodiments, an intersection of the second posterior table edge (345) and the second table edge (370) lies in a first quadrant (540). In some embodiments, an intersection of the anterior first table edge (350) and the first posterior table edge (340) lies in a second quadrant (550). In some embodiments, the rounded recessed edge (380) lies in a third quadrant (560). In some embodiments, an intersection of the anterior table edge (330) and the second table edge (370) lies in a fourth quadrant (570).

In some embodiments, a linear guide line (600) is located on the top table surface (310) from the anterior table edge (330) to the second posterior table edge (345).

In some embodiments, the system (100) comprises a clamping means (610) for securing the drill bit (110) to the sharpening table (300). In some embodiments, the system (100) comprises a clamping means (610) for securing the drill bit (110) to the positioning component (400).

In some embodiments, the positioning component (400) comprises a securing means (630) to affix an angle of the positioning component (400) with respect to the sharpening wheel face (232).

In some embodiments, the system (100) comprises a spacer block (620) for adjusting a planar elevation of the sharpening table (300) with respect to the positioning table (240). In some embodiments, the angle of the radial sharpening wheel face (232) with respect to the drill bit (110) can be set to a predetermined value based on an elevation of the sharpening table (300) via the spacer block (620). In some embodiments, the spacer block (620) comprises a predetermined thickness. In some embodiments, the spacer block (620) comprises an even thickness throughout. In some embodiments, the spacer block (620) comprises a thickness tapering from a spacer block first edge (622) to a spacer block second edge (624). In some embodiments, the system (100) comprises a plurality of spacer blocks (620) of the same thickness. In some embodiments, the system (100) comprises a plurality of spacer blocks (620) of various thicknesses. In some embodiments, the spacer block (620) is located on the bottom table surface (320). In some embodiments, the sharpening table (300) is secured into position having the spacer block (620) located beneath it. In some embodiments, the sharpening table (300) with the spacer block (620) located beneath it is secured to the positioning table (240) via fastening the table mounts (390).

As used herein, the term "about" refers to plus or minus 10% of the referenced number. For example, an embodiment wherein the positioning table is about 10 inches in length includes a positioning table that is between 9 and 11 inches in length.

The disclosures of the following U.S. Patents are incorporated in their entirety by reference herein: U.S. Pat. No. 1,944,540; U.S. Pat. No. 2,887,833; U.S. Pat. No. 3,397,492; U.S. Pat. No. 3,411,249; U.S. Pat. No. 3,703,055; U.S. Pat. No. 4,520,599; U.S. Pat. No. 4,658,549; U.S. Pat. No. 4,848,036; U.S. Pat. No. 6,676,494.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

In some embodiments, the positioning table (240) is an adjustable tool rest. In some embodiments, the positioning table (240) is a non-adjustable tool rest. In some embodiments, the positioning table (240) is angularly adjustable with respect to Plane D (535). In some embodiments, the positioning table (240) is adjustable within a range from 0 to 30 degrees with respect to Plane D (535). In some embodiments, the positioning table (240) is adjustable within a range from 30 to 60 degrees with respect to Plane D (535). In some embodiments, the positioning table (240) is pivotally adjustable at an intersection of Plane A (500) and Plane D (535). In some embodiments, the positioning table (240) comprises a pivoting hinge (700) and a positioning clamp assembly (710). In some embodiments, the positioning clamp assembly (710) comprises a first slotted flange (720) perpendicularly located on a bottom (245) of the positioning table (240) having a slot (730) located along an arc. In some embodiments, a second slotted flange (760) having a slot (730) located along an arc is perpendicularly located on the bench grinder (200) having a side interfacing the side of the first slotted flange (720). In some embodiments, the positioning clamp (710) further comprises a screw and nut inserted throughout the slots (730) for clamping the positioning table (240) into a fixed position.

Figure 11A:
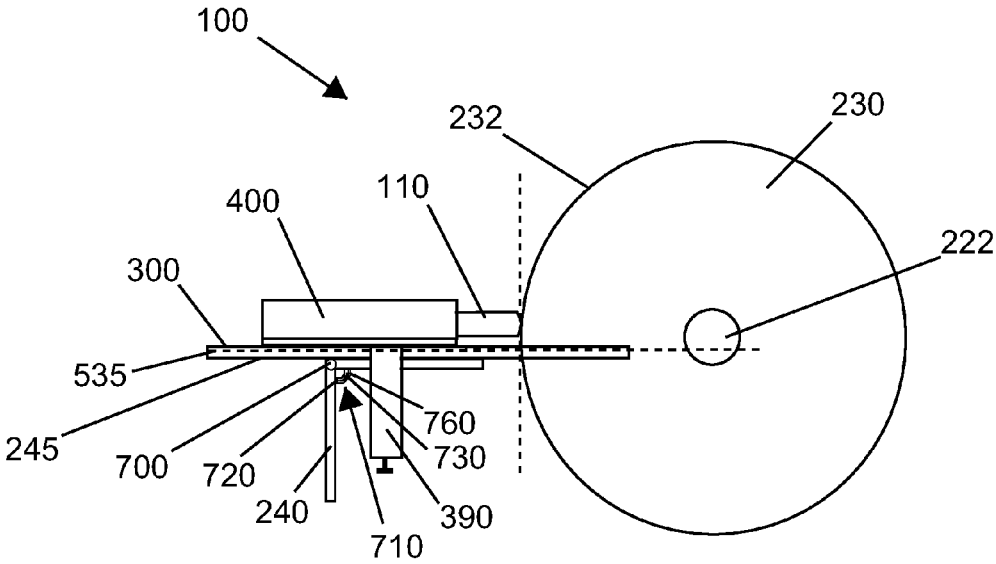
FIG. 11A is a side view of an alternate embodiment of the present invention.
Figure 11B:
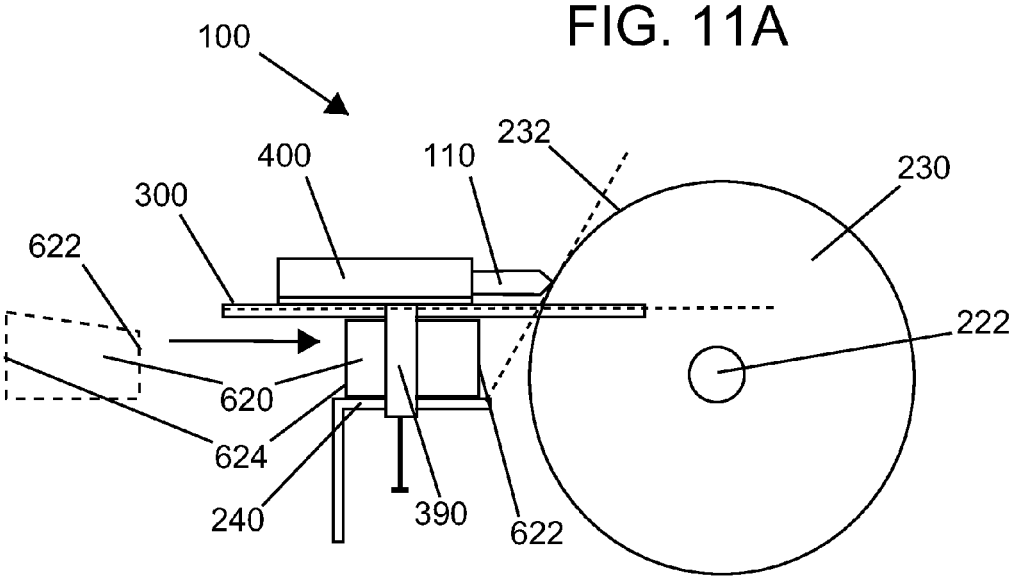
FIG. 11B is a side view of an alternate embodiment of the present invention featuring the spacer block.

In some embodiments, the positioning table (240) is adjustable about the pivoting hinge (700) as to open up the 90 degree angle shown about the pivoting hinge in FIG. 11A to where the angle would be obtuse about the pivoting hinge (700), with 110 angled towards top right of drawing sheet for FIG. 11A.

What is claimed is:

1. A drill bit sharpening system (100) using a typical bench grinder (200) with a sharpening table (300) for refurbishing a dull or broken drill bit (110), wherein said system (100) comprises:

(a) a bench grinder (200) having a motor (210) operatively coupled to a rotating shaft (220), wherein the rotating shaft (220) comprises a sharpening wheel (230) disposed on a shaft end (222), wherein the bench grinder (200) further comprises a generally planar positioning table (240) disposed in an anterior position thereon with respect to a sharpening wheel face (232);

a generally planar rigid sharpening table (300) having a top table surface (310), a bottom table surface (320) opposite to and generally parallel with the top table surface (310), a first table edge (330), third table edge (340) proximal to the sharpening wheel face (232), a fifth table edge (345), a sixth table edge (350), a fourth table edge (360), and a second table edge (370) opposite to and parallel with the sixth table edge (350) and the fourth table edge (360); and c) a positioning component (400) disposed on the table top surface (310) comprising an elongated planar wall component (410) having a first wall component edge (411) and a second wall component edge (412), wherein the positioning component (400) further comprises an elongated planar floor component (420) having a first floor component edge (421) and a second floor component edge (422), wherein the first floor component edge (421) is perpendicularly attached to the second wall component edge (412), wherein the positioning component 400 comprises a generally "L" shaped cross-section in a transverse plane;

wherein for use, the sharpening table (300) is attached to the positioning table (240) of the bench grinder (200), wherein the energized motor (210) rotates the sharpening wheel (230) via the rotating shaft (220), wherein for operation the drill bit (110) is placed against the positioning component (400) on the sharpening table (300) and held against the rotating sharpening wheel face (232) for shaping, wherein the drill hit (110) is manually rotated against the sharpening wheel face (232) via a users fingers on the drill bit (110);

wherein the bottom table surface (320) comprises a table mount (390) disposed thereon for removably and rigidly attaching to the positioning table (240).

2. A drill bit sharpening system (100) using a typical bench grinder (200) with a sharpening table (300) for refurbishing a dull or broken drill bit (110), wherein said system (100) comprises:

(a) a bench grinder (200) having a motor (210) operatively coupled to a rotating shaft (220), wherein the rotating shaft (220) comprises a sharpening wheel (230) disposed on a shaft end (222), wherein the bench grinder (200) further comprises a generally planar positioning table (240) disposed in an anterior position thereon with respect to a sharpening wheel face (232);

(b) a generally planar rigid sharpening table (300) having a top table surface (310), a bottom table surface (320) opposite to and generally parallel with the to table surface (310), a first table edge (330), a third table edge (340) proximal to the sharpening wheel face (232), a fifth table edge (345), a sixth table edge (350), a fourth table edge (360), and a second table edge (370) opposite to and parallel with the sixth table edge (350) and the fourth table edge (360); and (c) a positioning component (400) disposed on the table top surface (310) comprising an elongated planar wall component (410) having a first wall component edge (411) and a second wall component edge (412), wherein the positioning component (400) further comprises an elongated planar floor component (420) having a first floor component edge (421) and a second floor component edge (422), wherein the first floor component edge (421) is perpendicularly attached to the second wall component edge (412), wherein the positioning component (400) comprises a generally "L" shaped cross-section in a transverse plane;

wherein for use, the sharpening table (300) is attached to the positioning table (240) of the bench grinder (200), wherein the energized motor (210) rotates the sharpening wheel (230) via the rotating shaft (220), wherein for operation the drill bit (110) is placed against the positioning component (400) on the sharpening table (300) and held against the rotating sharpening wheel face (232) for shaping, wherein the drill bit 110 is manually rotated against the sharpening wheel face (232) via a users fingers on the drill bit (110);

wherein the system (100) comprises a spacer block (620) for adjusting a planar elevation of the sharpening table (300) with respect to the positioning table (240), wherein the angle of the sharpening wheel face (232) with respect to the drill bit (110) is set to a predetermined value based on an elevation of the sharpening table (300), wherein the spacer block (620) is disposed on the bottom table surface (320), wherein the spacer block (620) comprises a predetermined thickness.

3. A drill bit sharpening system (100) using a typical bench grinder (200) with a removable sharpening table (300) for refurbishing a dull or broken drill bit (110), wherein said system (100) comprises:

(a) a bench grinder (200) having a motor (210) operatively coupled to a rotating shaft (220), wherein the rotating shaft (220) comprises a sharpening wheel (230) disposed on a shaft end (222), wherein the bench grinder (200) further comprises a generally planar positioning table (240) disposed in an anterior position thereon with respect to a sharpening wheel face (232), wherein the motor (210) is operatively connected to a power switch (250) and a power source (260);

(b) a generally planar rigid sharpening table (300) having a top table surface (310), a bottom table surface (320) opposite to and generally parallel with the top table surface (310), a first table edge (330), a third table edge (340) proximal to the sharpening wheel face (232), a fifth table edge (345), a sixth table edge (350), a fourth table edge (360), and a second table edge (370) opposite to and parallel with the sixth table edge (350) and the fourth table edge (360), a rounded recessed edge (380) adjoining the first table edge (330) and the sixth table edge (350), wherein the bottom table surface (320) comprises a table mount (390) disposed thereon for removably and rigidly attaching to the positioning table (240);

(c) a pivotally mounted positioning component (400) disposed on the table top surface (310) comprising an elongated planar wall component (410) having a first wall component edge (411), and a second wall component edge (412), wherein the positioning component (400) further comprises an elongated planar floor component (420) having a first floor component edge (421) and a second floor component edge (422), wherein the first floor component edge (421) is perpendicularly attached to the second wall component edge (412), wherein the positioning component (400) comprises a generally "L" shaped cross-section in a transverse plane, wherein the positioning component (400) comprises a pivoting means (430) centrally disposed therein for rotatably mounting to a top table surface (310);

wherein the pivoting means (430) is disposed on the top table surface (310) on a vertical plane, Plane A (500), about midway between the first table edge (330) and the third table edge (340), wherein, the pivoting means (430) is disposed on the top table surface (310) on a vertical plane, Plane B (510), about midway between the sixth table edge (350) and the fourth table edge (360), wherein Plane B (510) is disposed parallel with a vertical plane, Plane C (530), on which the sharpening wheel (230) is disposed, wherein Plane B (510) is perpendicular to Plane A (500), wherein the pivoting means (430) is disposed on the top table surface (310) at an intersection of Plane A (500) and Plane B (510), wherein, the positioning component (400) rotates about the pivoting means (430) in a horizontal plane;

wherein the rounded recessed edge (380) is disposed on a radius, Radius E (520), wherein Radius E (520) comprises a center disposed at an intersection of Plane A (500) and Plane B (510), wherein a plane, Plane D (535), is disposed perpendicular to Plane A (500), Plane B (510), and Plane C (530), wherein, the top table surface (310) lies on Plane D (535), wherein, Plane D (535) is divided into four quadrants by intersecting planes, Plane A (500) and Plane B (510), wherein an intersection of the fifth table edge (345) and the second table edge (370) lies in a first quadrant (540), wherein an intersection of the sixth table edge (350) and the third table edge (340) lies in a second quadrant (550), wherein, the rounded recessed edge (380) lies in a third quadrant (560), wherein an intersection of the first table edge (330) and the second table edge (370) lies in a fourth quadrant (570); and (d) a spacer block (620) for adjusting a planar elevation of the sharpening table (300) with respect to the positioning table (240), wherein the angle of the sharpening wheel face (232) with respect to the drill bit (110) is set to a predetermined value based on an elevation of the sharpening table (300), wherein the spacer block (620) is disposed on the bottom table surface (320), wherein the spacer block (620) comprises a predetermined thickness;

wherein for use, the sharpening table (300) is attached to the positioning table (240) of the bench grinder (200) (optionally via the spacer block 620) via the table mount (390), wherein the bench grinder (200) is activated via the power switch (250) and the power source (260), wherein the motor (210) rotates the sharpening wheel (230) via the rotating shaft (220), wherein for operation, the drill bit (110) is placed against the positioning component (400) on the sharpening table (300), and held against the rotating sharpening wheel face (232) for shaping, wherein the drill bit (110) is manually rotated against the sharpening wheel face (232) via a users fingers on the drill bit (110) extending past the rounded recessed edge (380).

4. The system (100) of claim 3, wherein a linear guide line (600) is disposed on the top table surface (310) from the first table edge (330) to the fifth table edge (345).

5. The system (100) of claim 3, wherein the system (100) comprises a clamping means (610) for securing the drill bit (110) to the sharpening table (300).

6. The system (100) of claim 3, wherein the system (100) comprises a clamping means (610) for securing the drill bit (110) to the positioning component (400).

7. The system (100) of claim 3, wherein the positioning component (400) comprises a securing means (630) to affix an angle of the positioning component (400) with respect to the sharpening wheel face (232).

8. The system (100) of claim 3, wherein the spacer block (620) comprises an even thickness throughout.

9. The system (100) of claim 3, wherein the spacer block (620) comprises a thickness tapering from a spacer block first edge (622) to a spacer block second edge (624).

* * * * *